US010950407B2

(12) United States Patent
Kimura et al.

(10) Patent No.: US 10,950,407 B2
(45) Date of Patent: Mar. 16, 2021

(54) ELECTRON GUN

(71) Applicant: New Japan Radio Co., Ltd., Tokyo (JP)

(72) Inventors: Toru Kimura, Fujimino (JP); Misao Iseki, Fujimino (JP); Hideyuki Obata, Fujimino (JP)

(73) Assignee: New Japan Radio Co., Ltd., Tokyo (JP)

( * ) Notice: Subject to any disclaimer, the term of this patent is extended or adjusted under 35 U.S.C. 154(b) by 0 days.

(21) Appl. No.: 16/897,828

(22) Filed: Jun. 10, 2020

(65) Prior Publication Data

US 2020/0395185 A1 Dec. 17, 2020

(30) Foreign Application Priority Data

Jun. 12, 2019 (JP) ..... JP2019-109692

(51) Int. Cl.
*H01J 13/02* (2006.01)
*H01J 3/02* (2006.01)
*H01J 3/10* (2006.01)

(52) U.S. Cl.
CPC ..... *H01J 3/027* (2013.01); *H01J 3/024* (2013.01); *H01J 3/029* (2013.01); *H01J 3/10* (2013.01); *H01J 2201/28* (2013.01)

(58) Field of Classification Search
CPC ..... H01J 1/13; H01J 1/15; H01J 9/04
See application file for complete search history.

(56) References Cited

U.S. PATENT DOCUMENTS

| | | | | |
|---|---|---|---|---|
| 14,091,311 | | 5/1978 | Mendelsohn et al. | |
| 8,907,550 | B2 * | 12/2014 | Zaderej | F21V 29/89 313/46 |
| 2010/0028562 | A1 | 2/2010 | Nakagawara et al. | |

FOREIGN PATENT DOCUMENTS

| | | |
|---|---|---|
| CN | 202633200 U | 12/2012 |
| JP | 2010053443 | 3/2010 |
| WO | 2016/029065 | 2/2016 |

* cited by examiner

*Primary Examiner* — Joseph L Williams
(74) *Attorney, Agent, or Firm* — Christopher M. Scherer; DeWitt LLP

(57) ABSTRACT

An electron gun comprising a cathode having an electron emitting surface and whose planar shape is circular; a heater; an anode being arranged to oppose the cathode; and a heat resistant member. The anode applies a positive potential relative to the cathode to extract electrons in a predetermined direction. The cathode has, in a central portion thereof, a through hole along a central axis of the cathode. The heat resistant member has a first portion to close the through hole and a second portion being positioned between the cathode and the heater.

20 Claims, 5 Drawing Sheets

ELECTRON GUN

CROSS-REFERENCE TO RELATED APPLICATIONS

The present application claims priority to Japanese Patent Application No. 2019-109692, filed Jun. 12, 2019, the content of which is incorporated herein by reference in its entirety.

TECHNICAL FIELD

The present invention relates to an electron gun and particularly relates to an electron gun to supply electrons to operate an electron beam generating apparatus, a linear accelerator (Linac), a traveling wave tube (TWT), a Klystron and the like.

BACKGROUND OF THE INVENTION

In the electron beam generating apparatus, Linac, TWT, and Klystron as applications for using electron beams, as shown in FIG. 7, an electron gun 101 to emit thermions by using a heater 105 to heat a cathode 102 in which a thermionic emission substance is splayed onto, coated onto, or impregnated into a metal base body is provided. The related-art electron gun 101 emits electrons in a predetermined orientation and, moreover, to focus the electron beams, it is used by applying, to an anode 103 and a Wehnelt 104, a positive electric potential relative to the cathode 102. In addition to the diode configuration shown in FIG. 7, as shown in FIG. 8, a method can also be provided for controlling the electron flow rate by applying a positive control voltage relative to the cathode with a grid 106 being arranged to provide a triode.

Either of the cases in FIG. 7 and FIG. 8 can be applied in an application in which electrons can be utilized directly, for example, with electrons being emitted from the electron gun 101 and the emitted electron beams being focused in a predetermined orientation by an electric field or magnetic field or in which they can be utilized indirectly in generating X rays with the energy at the time electrons are made to collide with a target, and, moreover, it can be applied in an application to accelerate electrons by a high-frequency electric field to increase energy, such as in Linac, to obtain higher energy or to accelerate/delay the electron flow and velocity modulated by a high-frequency electric field, such as in TWT or Klystron.

In either of the above-described application cases, not all of the emitted electron beams are transmitted to the following section (for example, Linac, TWT or the like), but reflection certainly occurs, so that some thereof return back to the electron gun 101 side (see WO2016/029065A1). Moreover, collision of electrons causes secondary electrons to be produced, which may advance to the electron gun 101 side. Furthermore, ions receiving energy from the electrons may also return back to the electron gun 101. In either of the cases, the energy that the electrons, the secondary electrons, or the ions have often causes damage to the grid 106 and the cathode 102 due to an overheating or shock when they collide with the grid 106 and the cathode 102. Therefore, the electron gun often reaches, in a short time before it goes through the original exhaustion life, the state such that emission decreases or arcing occurs.

The technique described in JP2010-053443A relates to a deposition apparatus comprising a plasma generating apparatus, wherein the deposition apparatus is designed such that electrons, secondary electrons, and ions are incident on the electron return back electrode to be returned back by providing an electron return back electrode. However, in a case of an electron gun for use in Linac or TWT, electrons or ions return linearly in a direction being opposite to the direction of the emitted electron beams, and therefore it is impossible to collect electrons or ions due to such a structure or position of the electrodes.

Moreover, a method is known for preventing back bombardment (a phenomenon in which only some electrons in electrons being emitted from a cathode and being in an accelerating phase obtain energy from a high-frequency electric field to return to and collide with the cathode) to a cathode, as a structure called a hollow cathode with a through hole having a diameter of between 1.8 and 2.2 mm being formed at the center of the cathode, to avoid a temperature rise of the cathode due to return back of some of the electrons being emitted from the cathode, secondary electrons and iones being produced by the electrons colliding in the next connected application, to the cathode (see CN202633200U).

SUMMARY OF THE INVENTION

However, there is a problem that, even with the method disclosed in CN202633200U, electrons or ions hit a heater, or an insulating material to hold and insulate the heater, so that, due to collision energy or subsequent heat, the insulating material is degraded or gas is generated from the insulating material. To avoid the above-mentioned problem, there is a problem that, with a conventional hollow cathode, it is necessary to arrange a wound heater wire to heat the cathode so as to avoid the position being on the central axis of the cathode, and how the heater wire is wound gets so complicated as to be a cause of a cost increase. On the other hand, as for the insulating material to hold and insulate the heater, there is also a problem that a central portion of the cathode corresponding to being on the central axis of the cathode cannot be made to be have an open structure in view of the object thereof.

Thus, an object of the present invention is to provide an electron gun that can suppress a temperature increase or degradation of a heater or an insulating material to achieve a longer life time.

To achieve the above-described object, the present disclosure relates to an electron gun comprising a cathode having an electron emitting surface and whose planar shape is circular; a heater; an anode being arranged to oppose the cathode, wherein a through hole along a central axis of the cathode is provided in a central portion of the cathode; and a heat resistant member having a first portion to close the through hole and a second portion being positioned between the cathode and the heater is arranged in the electron gun.

According to the present disclosure, even in a case that electrons, secondary electrons, or ions return back toward a cathode from the following section (for example, Linac, TWT or the like) utilizing electron beams being emitted from an electron gun, they pass through a through hole being provided at the center of the cathode, a local shock and heat generation at the center of an electron emitting surface of the cathode (a surface of the cathode) is suppressed and the electrons or ions that passed through the through hole collides with a heat resistant member, causing heat generation due to back bombardment of the electrons or ions to be diffused by the heat resistant member to portions other than the cathode surface.

DETAILED DESCRIPTION

Below, the present disclosure is described based on embodiments shown in FIGS. 1 to 6. Each of the figures is merely a figure to describe the schematic configuration of an electron gun 1 according to the present disclosure, so that it is not to strictly represent the detailed structure of each of the portions or the mutual dimensional relationship between the portions.

Embodiment 1

Figure 1:
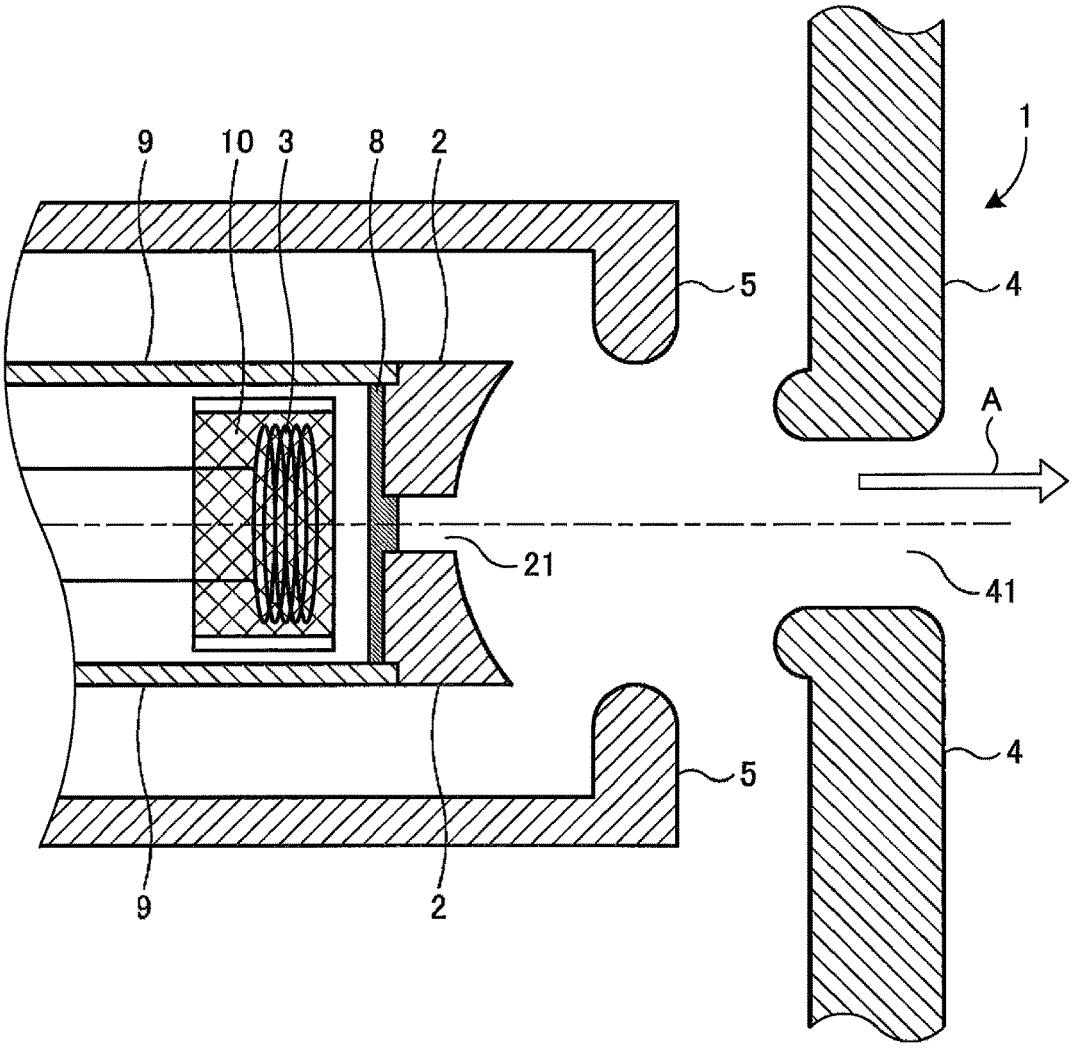
FIG. 1 schematically shows a cross-sectional view of the configuration of an electrongun according to an embodiment 1 of the present disclosure.

FIG. 1 is a cross-sectional view of the schematic configuration of an electron gun 1 according to an embodiment 1. The electron gun 1 according to the above-mentioned embodiment 1 is a diode electron gun. The above-mentioned electron gun 1 is configured differently from the related-art electron gun in that, primarily, the electron gun 1 is provided with a heat resistant member 8 upon a through hole 21 being formed in a cathode 2. While explanations will be omitted for the configuration equivalent to that according to the related art, the embodiment 1 generally has the following configuration.

In other words, the electron gun 1 comprising the cathode 2; a heater 3; an anode 4; and a Wehnelt 5, wherein electrons are emitted primarily in an arrow A orientation from an opening 41 being formed in the anode 4. The electron gun 1 is housed in a housing (not shown) being formed with an insulating member, and is connected to a vacuum apparatus to operate with the interior of the electron gun 1 being maintained in a vacuum.

The cathode 2 is supported by a sleeve 9 being conductive and, moreover, with the anode 4 and the Wehnelt 5 being individually supported by each electrically separated conductive members, respectively, the mutual positional relationships in the housing are fixed.

The cathode 2 having an electron emitting surface and whose planar shape is circular is to be heated by the heater 3 and to emit electrons. The cathode 2 is formed by splaying onto, coating onto, or impregnating into a metal base body a thermionic emission substance, for example. A predetermined electric potential is applied by a power supply (not shown) to the cathode 2. This cathode 2 is supported by the sleeve 9. The through hole 21 is formed in a central portion of this cathode 2 along a central axis of the cathode (along a direction being perpendicular to the circular planar shape of the cathode). The above-mentioned through hole 21 is to be described later.

For the metal base body making up the cathode, one being excellent in heat resistance, low in gas evaporation, and small in work function, for example, tungsten, is used. In a case of the metal base body making up an impregnated type cathode, a raw material into which an emitter material can be impregnated, for example, a porous tungsten, a porous tungsten compound, a raw material in which the porous tungsten is doped with another element, or the like is further used. An electron emission substance (emitter material) to be impregnated includes barium, rhenium, strontium, for example, or a compound containing these, and is used by mixing alumina at the time of impregnating. The thermal conductivity of the metal base body is preferably high, so that, for example, the thermal conductivity of tungsten is 173 ($W \cdot m^{-1} \cdot k^{-1}$).

The heater 3 is to heat the cathode 2. The heater 3 is surrounded and held by an insulating material 10. The insulating material 10 is formed with a material having insulating property and heat resistance and is formed specifically by sintering alumina, for example.

The anode 4 being arranged to oppose the cathode is to advance electrons being emitted from the cathode 2 such that they are made to pass through the opening 41 of the anode 4. A predetermined electric potential is applied to the anode 4 using a power supply (not shown).

The Wehnelt 5 is an electrode to focus the electrons being emitted from the cathode 2 such that the electrons can efficiently pass through the opening 41 of the anode 4. A predetermined electric potential is applied to the Wehnelt 5 using a power supply (not shown).

The electron gun 1 is used in combination with an application for using electron beams (for example, an electron beam generating apparatus, Linac, TWT, Klystron, or the like). At this time, some of electrons return back to the electron gun 1 side with reflection occurring on the application side, secondary electrons being produced by collision of the electrons return to the electron gun 1 side, or ions receiving energy from the electric field in a next application and move toward to the electron gun 1 side. Such electrons, secondary electrons, and ions are called "returned back electrons" herein.

Then, in the electron gun 1 according to the above-mentioned embodiment 1, the through hole 21 along the central axis of the cathode (along the arrow A direction) is provided in the central portion of the cathode 2 having an electron emitting surface and whose planar shape is circular, and the heat resistant member 8 is provided on the side of the bottom surface being a surface opposite to the electron emitting surface of the cathode 2 (a surface of the cathode 2). The above-mentioned heat resistant material 8 has a first portion (a portion opposing the through hole 21, including a projection 82, according to the embodiment 1) to close the through hole 21 and a second portion (an annular flat-plate like portion 81 surrounding the first portion, according to the embodiment 1) being positioned between the cathode 2 and the heater 3 (on the bottom surface of the cathode 2).

The through hole 21 is to prevent the cathode 2 from deforming or degrading emission ability due to the energy of back bombardment of the returned back electrons that return back to the electron gun 1 side. The thorough hole 21 is formed, in the central portion of the cathode 2, as a hole whose cross section being orthogonal to the central axis (the arrow A direction) of the cathode is circular and to pass through the cathode 2 along the central axis of the cathode (along the arrow A (the traveling direction of electrons)). While the diameter of the circle being a cross section orthogonal to the central axis of the cathode 2 of the through hole 21 is often set to be approximately 1 to 3 mm to provide merely one example, it is set while taking into account the electron beam diameter or the focusing electric field. The outer diameter of the cathode 2 in this case is approximately 3 to 15 mm.

The heat resistant member 8 is to collect returned back electrons that return back through the through hole 21 being provided in the cathode 2 to prevent damage to a component and, at the same time, diffuse heat generated by collision. The heat resistant member 8 is formed to cover the through hole 21 being provided in the cathode 2 without gaps to close the through hole 21, and is installed on the bottom surface (the end surface on the heater 3 side) of the cathode 2. It is preferably joined to the bottom surface of the cathode 2. Moreover, the heat resistant member 8 is preferably provided such that a part thereof comes into contact with the sleeve 9. The heat resistant member 8 comes into contact with the bottom surface of the cathode 2, or the sleeve 9 to cause heat of the heat resistant member 8 to be conducted to the cathode 2.

The heat resistant member 8 is formed with a material having a high heat resistance and is preferably formed with a material that can be used stably without causing heat deformation or gas evaporation even at a temperature expected for the heat resistant member 8 at the time of using the electron gun 1. Moreover, preferably, the heat resistant member 8 is formed with a metal being high in work function and low in secondary electron yield. This makes it possible to suppress production of secondary electrons and tertiary electrons at the time the returned back electrons that return back to the electron gun 1 side collide with the heat resistant member 8 and to prevent electron beams being emitted from the electron gun 1 from being influenced. The heat resistant member 8 preferably has the heat conductivity being greater than that of the cathode 2. This is because it is good functioned to diffuse heat due to back bombardment over the entire cathode while avoiding local heating. However, even when the heat conductivity of the heat resistant member 8 is the same as that of the cathode 2, it is effective in that the surface of the cathode 2 can avoid a shock due to the returned back electrons. Specifically, the heat resistant member 8 is formed with a highly heat resistant member such as molybdenum (with the thermal conductivity of 138 $W \cdot m^{-1} \cdot k^{-1}$), tungsten, tantalum or hafnium, or a compound or mixture of these, or an alloy containing these, for example. Alternatively, the heat resistant member 8 can be formed with ceramics or SiC (silicon carbide).

The heat resistant member 8 and the cathode 2 can be made to have the same electric potential by forming the heat resistant member 8 with a metal to electrically connect the heat resistant member 8 to a part to be the same electric potential as that of the cathode 2 (or, possibly, to install the heat resistant member 8 to the cathode 2). This never blocks the workings of making electrons being emitted from the cathode 2 advance such that they move toward the opening 41 of the anode 4 by the voltage as a difference between the electric potential applied to the anode 4 and the electric potential applied to the cathode 2. In other words, the heat resistant member 8 can be provided upon avoiding the functioning as the electron gun 1 being blocked.

Here, as the insulating material 10 is formed with a material having heat resistance, most of the heating of the cathode 2 uses heat conduction or heat radiation through the insulating material 10 or the sleeve 9, not direct radiation from the heater 3. According to a study by the inventors, it has been confirmed that the efficiency of heating the cathode 2 using the heater 3 does not significantly decrease because the thickness of the heat resistant member 8 is suitably adjusted. In other words, the heat resistant member 8 can be suitably placed to diffuse the heat on surface of the cathode 2 caused by the collision of returned back electrons and be adjusted to not significantly decrease the efficiency of heating the cathode 2 by the heater 3.

While being dependent on the physical property of the heat resistant member 8, according to a study by the inventors, it has been confirmed that it is possible to ensure that the efficiency of heating the cathode 2 using the heater 3 do not significantly decrease by bringing the thickness of a portion (the thickness of a flat plate-like portion) of the heat resistant member 8 that exists between the heater 3 and the cathode 2 to be no greater than 1 mm, for example.

While the heat resistant member 8 can be formed in a mere flat plate shape with both the surface and the bottom thereof being planar (in other words, formed so as to have a constant thickness in an emission direction A of the electrons), to ensure that the efficiency of heating the cathode 2 using the heater 3 do not significantly decrease while effectively preventing a mechanical degradation such as thermal deforming of or changing the surface state of the heat resistant member 8 due to the energy of back bombardment of the returned back electrons, a portion in which the returned back electrons that pass through the through hole 21 of the cathode 2 collide (a portion opposing the through hole 21) can be made thicker while the other portion (a portion not opposing the through hole 21) can be made thinner. In other words, while the flat plate-like portion 81 being the second portion cannot be thickened so much in order to not block heat from the heater 3, there is a risk that thermal deforming easily occurs in the first portion opposing the through hole 21 when the whole heat resistant member 8 is thinned. Therefore, it is considered to thicken the central portion opposing the through hole 21 to prevent deforming.

Figure 2:
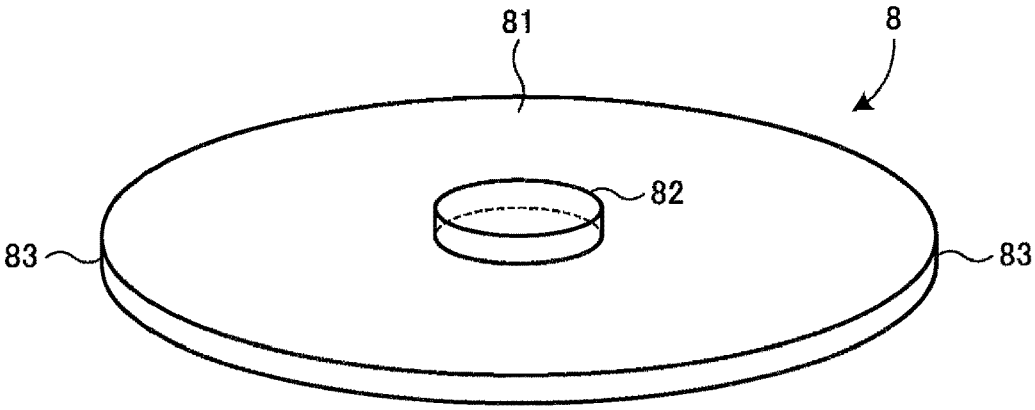
FIG. 2 shows a perspective view of a heat resistant member of the electron gun in FIG. 1.

Specifically, the heat resistant member 8 can be formed into a shape as shown in FIG. 2, for example. The heat resistant member 8 shown in FIG. 2 having only a portion in which the returned back electrons passing through the through hole 21 of the cathode 2 collide (a portion opposing the through hole 21) is made thicker has the flat plate-like portion 81 and the projection 82 being formed on one surface of the flat plate-like portion 81. The above-mentioned configuration makes it possible to prevent thermal deforming, making the configuration suited to diffuse heat. With the heat resistant member 8 being installed to the cathode 2 by the flat plate-like portion 81 being joined to the end surface on the heater 3 side of the cathode 2 (the bottom surface of the cathode 2), the projection 82 is fitted into the through hole 21 of the cathode 2. In the example shown in FIG. 2, the flat plate-like portion 81 is formed into a circle and is made to be the flat plate-like portion 81 being circular. The form of the projection 82 is construed to be not limited to be of a coin type as shown in FIG. 2, so that it can also be of a type of a mountain having a foot. The heat resistant member 8 uses a plate normally being a difficult-to-cut material in a case of manufacturing the heat resistant member 8 by an one-piece process, so that a process to heighten the central portion thereof increases in time and cost. Therefore, the thickness of the projection 82 (the thickness of a portion protruding from the flat plate-like portion 81) is preferably set to be approximately one fourth to one tenth of the depth of the through hole 21. Making the projection 82 too long causes the heat balance with the flat plate-like portion 81 uneven, causing a likelihood of deforming or the need for an excessive cutting process time, and also a high cost. Moreover, in a case that the flat plate-like portion 81 has a thickness of approximately less than or equal to 1 mm, for example, the thickness of the projection 82 can be set to approximately 0.3 to 2.5 mm. To catch the returned back electrons to diffuse heat thereby, the above-mentioned thickness is sufficiently suitable.

Figure 3:
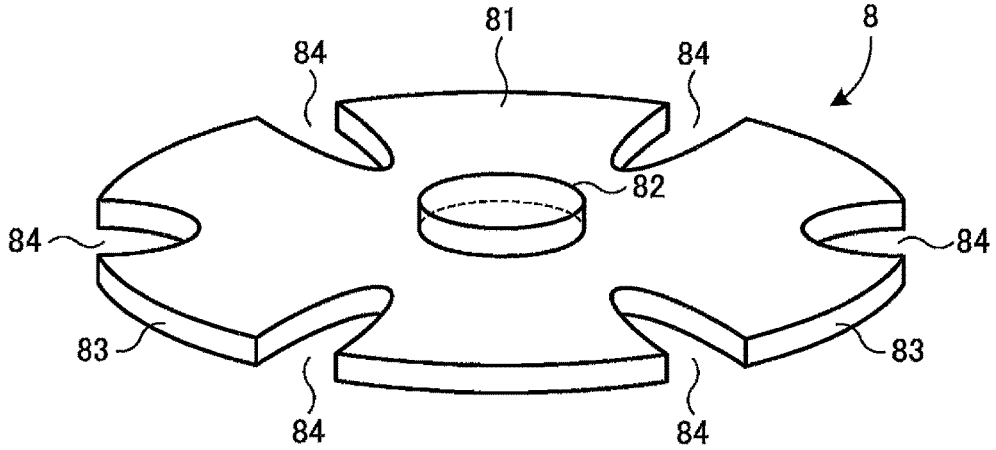
FIG. 3 shows a perspective view of another form of the heat resistant member.

While the entire periphery of a peripheral end 83 of the flat plate-like portion 81 being circular is brought to be in contact with the sleeve 9 with the heat resistant member 8 shown in FIG. 2 in a case that the heat resistant member 8 is in contact with the sleeve 9, as shown in FIG. 3, one or a plurality of notches 84 can be formed in the peripheral edge portion of the flat plate-like portion 81 and a part of the peripheral edge portion of the flat plate-like portion 81 can be brought into contact with the sleeve 9. Having the notch 84 formed in the flat plate-like portion 81 makes it possible to efficiently conduct radiant heat from the heater 3 (heat through the insulating material 10 or the sleeve 9) to the cathode 2 while securing the operation of conducting heat of the heat resistant member 8 to the sleeve 9 to secure the heating efficiency of the cathode 2.

Moreover, one or a plurality of holes can be formed in the flat plate-like portion 81 of the heat resistant member 8. Having the hole formed in the flat plate-like portion 81 makes it possible to efficiently conduct radiant heat from the heater 3 (heat through the insulating material 10 or the sleeve 9) to the cathode 2 while securing the operation of conducting heat of the heat resistant member 8 to the sleeve 9 to secure the heating efficiency of the cathode 2.

As long as a portion in which the returned back electrons that reach the heat resistant member 8 through the through hole 21 of the cathode 2 collide (a portion opposing the through hole 21; a portion opposing the through hole 21, including the projection 82 in the example shown in FIG. 2) is formed with a material having heat resistance, the entirety thereof can be formed as one entity (a one-piece component) or it can be configured with a plurality of components being combined.

Next, the operation of the electron gun 1 having such a configuration will be explained.

Heating of the cathode 2 by the heater 3 causes thermionic emission, causing the electron movement direction caused by the electric field between the cathode 2 and the anode 4 to be determined and electron beams to be focused with an influence of the electric field by the Wehnelt 5. In other words, the electrons being emitted from the cathode 2 move toward the opening 41 of the anode 4 by the voltage as a difference between the electric potentials applied to the anode 4 and the cathode 2.

Some of the electrons being emitted from the cathode 2 pass through the opening 41 of the anode 4, further advance primarily in the arrow A orientation, and move toward the following section in which the electron beams are utilized (for example, Linac, TWT or the like). Then, in the following section, electrons collide with gas or ions that exist in a small amount in a tube that should inherently be a vacuum in an ideal sense, and returned back electrons such as some of the electrons being reflected due to an influence by the electric field, or secondary electrons being produced by collision of the electron beams return back toward the cathode 2.

The returned back electrons that return back to the cathode 2 collide with the heat resistant member 8 via the through hole 21, and heat generated due to the back bombardment of the above-mentioned returned back electrons is diffused by the heat resistant member 8 and is mainly conducted to the bottom surface or the sleeve 9 side of the cathode 2. While some of the heat contributes to a temperature rise of the cathode 2, it is slight relative to the heat value of heating by the heater 3 being conduction from the bottom surface of the cathode 2 or the inner surface of the through hole 21, so that it contributes to heating of the entire cathode 2 in the same manner as heating by the heater 3. Therefore, it is not brought to a local heat generation at the center of the cathode 2 as in the related art, so that abnormally causing evaporation of a thermionic emission substance being impregnated into the surface of the cathode 2 or space (a void or pore) of a porous base metal is prevented.

According to the electron gun 1 of the embodiment 1 as described above, even in a case that returned back electrons that return back from the following section (for example, Linac, TWT or the like) utilizing electron beams being emitted from the electron gun 1 move toward the cathode 2, they pass through the through hole 21 provided at the center of the cathode 2, making it possible to suppress a local shock and heat generation at the center of the cathode 2, and also the returned back electrons that passed through the through hole 21 collide with the heat resistant member 8, so that heat generation due to back bombardment of the returned back electrons is diffused by the heat resistant member 8. Thus, even in an electron gun being designed with a very high beam current density, damaging of the cathode 2 can be prevented and, moreover, a temperature rise or degradation of the heater 3 or the insulating material 10 can be decreased. As a result, a change in physical property of the electron gun 1 can be prevented and a stable thermionic emission can be secured for a long time, and the electron gun 1 being brought to be unusable due to degradation before reaching the consumable life due to evaporation of thermionic emission of the cathode 2 can be avoided, making it possible to achieve a longer life.

Here, in a case that heat generation due to back bombardment of the returned back electrons that return back to the electron gun 1 side is not negligible, the heat value of the heater 3 can be set lower in advance to suppress overheating of the cathode 2 due to a temperature rise of the heat resistant member 8. In other words, according to the electron gun 1 of the above-mentioned embodiment 1, the heat resistant member 8 can be arranged in a space formed with the heater 3 in the vicinity of the cathode 2 to improve the degree of freedom of design of the heater 3. In other words, while a related-art hollow cathode is influenced by back bombardment, so that the heating wire of the heater or the insulating material cannot be arranged coaxially with the through hole of the cathode, but according to the electron gun 1 of the above-described embodiment 1, the heater 3 and the insulating material 10 can be arranged coaxially with the through hole 21 of the cathode 2, or, in other words, in the same manner as the design of the related-art electron gun.

Moreover, in a case that the heat resistant member 8 is formed so as to have the flat plate-like portion 81 and the projection 82 as shown in FIGS. 2 and 3, the returned back electrons that reach the heating resistant member 8 through the through hole 21 of the cathode 2 collide with the projection 82 whose thickness of the heat resistant member 8 is increased, making it possible to sufficiently diffuse heat generation due to back bombardment of the returned back electrons and, as for the heat resistant member 8 that exists between the cathode 2 and the heater 3, the thickness thereof as the flat plate-like portion 81 can be decreased to secure a high heating efficiency of heating the cathode 2 with heat from the heater 3 (heat through the insulating material 10 or the sleeve 9).

Embodiment 2

Figure 4:
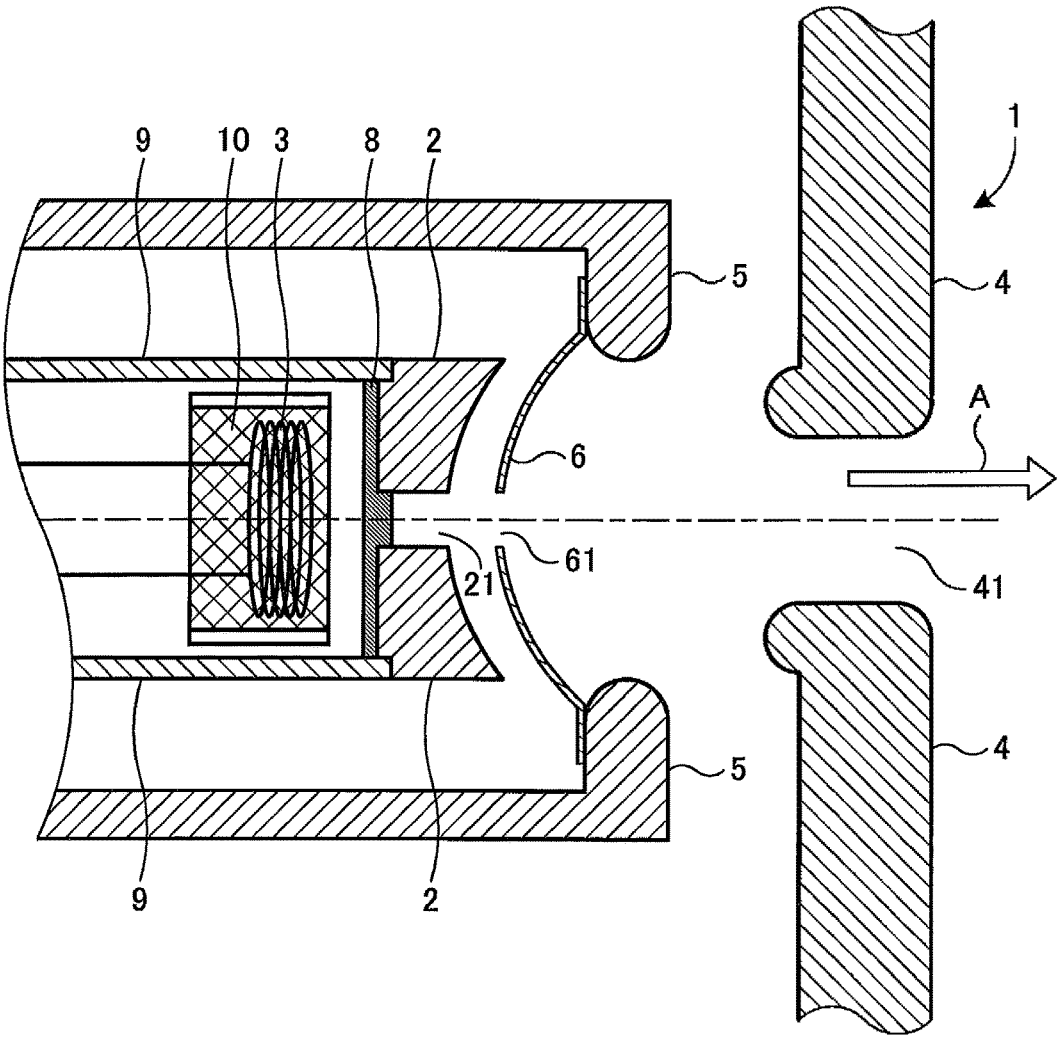
FIG. 4 schematically shows a cross-sectional view of the configuration of the electron gun according to an embodiment 2 of the present disclosure.

FIG. 4 is a cross-sectional view showing the schematic configuration of an electron gun 1 according to an embodiment 2. In the above-mentioned embodiment 2, in addition to the configuration being equivalent to that of the embodiment 1, a grid 6 is connected to a Wehnelt 5. In other words, the electron gun 1 according to the above-mentioned embodiment 2 is a triode electron gun. For the configuration being equivalent to that of the embodiment 1, the explanations thereof will be omitted by affixing the same letters thereto.

The grid 6 being to control cathode current is installed on the cathode 2 side of the Wehnelt 5. The grid 6 is driven by the electric potential being applied to the Wehnelt 5. The grid 6 is formed as having a structure such as a mesh or punching shape through which electrons can pass through, for example. A voltage to be negative relative to the anode 4 is applied to the grid 6 (and thereby a positive control voltage to the cathode 2 is applied to the grid 6 to control the flow of electrons), making it possible to control the cathode current by applying an electric field to further extract electrons from the cathode 2.

With the electric potential being applied to the Wehnelt 5 as an incentive, the traveling speed of electrons that passes through the grid 6 from the cathode 2 to advance in the orientation of an arrow A is controlled by the grid 6.

Then, the electron gun 1 according to the above-mentioned embodiment 2 is configured such that it comprises the grid 6 between the cathode 2 and the anode 4 to apply a positive control voltage to the cathode 2 and a hole 61 of the grid 6 is provided coaxially with a through hole 21 of the cathode 2.

The hole 61 is to prevent the deforming or degrading on the grid 6 due to the energy of back bombardment of the returned back electrons returning back to the electron gun 1 side. The hole 61 is formed as a circular hole penetrating the grid 6 along the emission direction A of electrons. The hole 61 of the grid 6 and the through hole 21 of the cathode 2 are respectively formed at positions to be coaxial along the central axis of the cathode 2 (along the arrow A). The diameter of a circle being a cross section of the hole 61 that is orthogonal to the central axis of the cathode 2 is set to approximately 1 to 3 mm to give merely one example. The hole 61 of the grid 6 and the through hole 21 of the cathode 2 are formed to have the same dimensions of diameter in the cross section being orthogonal to the central axis of the cathode 2.

In a case of the above-mentioned embodiment 2, returned back electrons that return back to the electron gun 1 pass through the hole 61 of the grid 6, and further pass through the through hole 21 of the cathode 2 to collide with the heat resistant member 8, and heat being generated due to back bombardment of the above-mentioned returned back electrons is conducted and diffused by the heat resistant member 8 and is primarily transmitted to the sleeve 9 side.

The electron gun 1 according to the above-mentioned embodiment 2 is configured to provide, upon providing the grid 6, the hole 61 in the grid 6, making it possible to control the traveling speed of electrons that move from the cathode 2, passing through the grid 6, and to improve the operability of the electron gun 1, and, moreover, to suppress a local shock and heat generation at the central portion of the grid 6, and to protect the grid 6 from being damaged.

Embodiment 3

Figure 5:
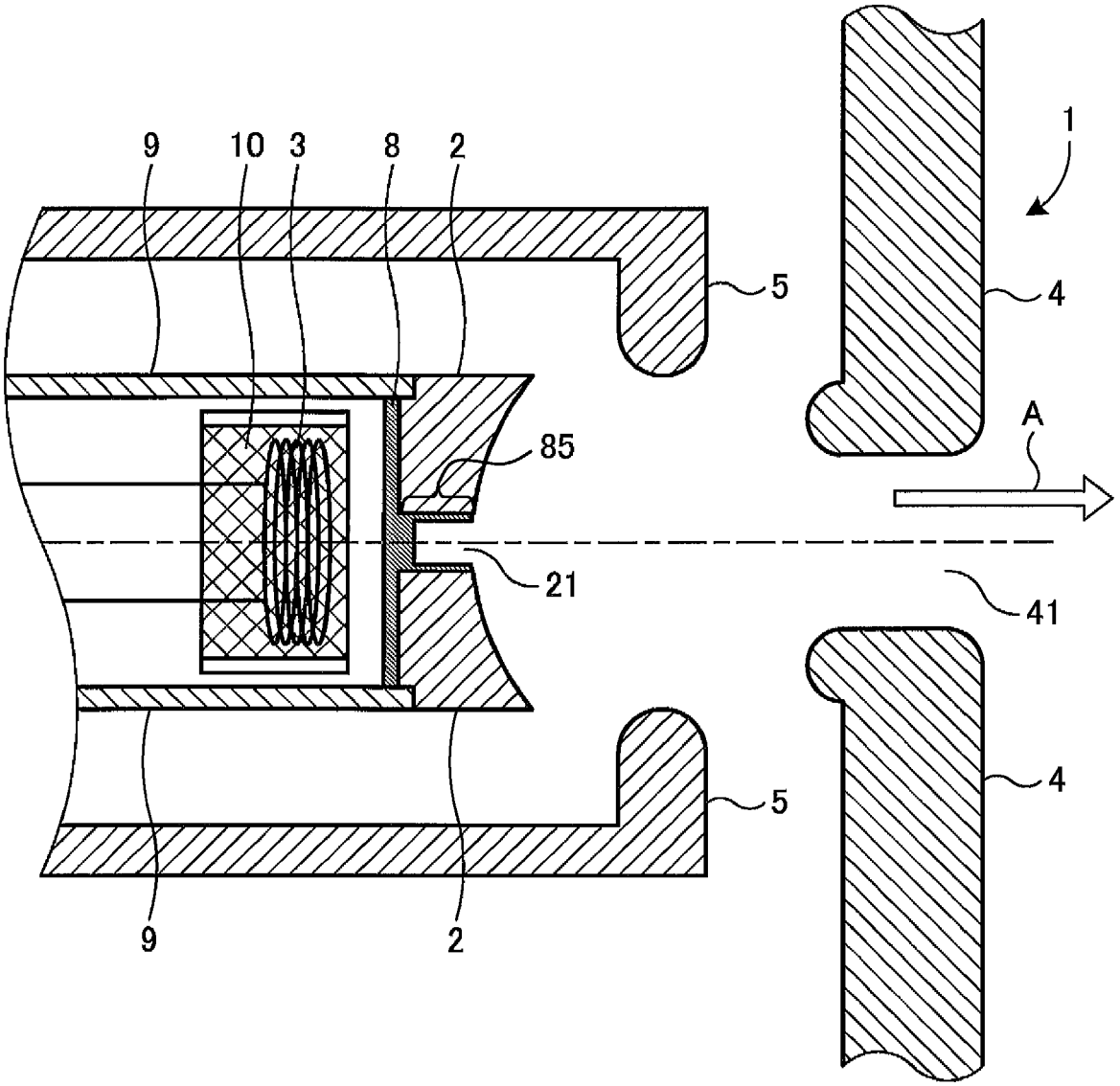
FIG. 5 schematically shows a cross-sectional view of the configuration of the electron gun according to an embodiment 3 of the present disclosure.

FIG. 5 is a cross-sectional view showing the schematic configuration of an electron gun 1 according to an embodiment 3. In the above-mentioned embodiment 3, the configuration of a heat resistant member 8 differs from the configuration of the heat resistant member 8 according to the embodiment 1. For the configuration being equivalent to that of the embodiment 1, the explanations thereof will be omitted by affixing the same letters thereto.

Figure 6:
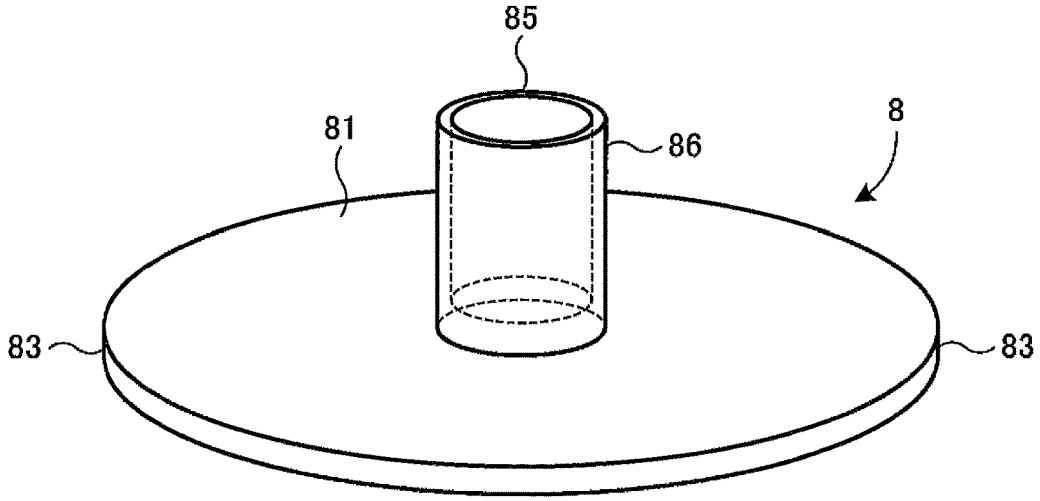
FIG. 6 shows a perspective view of a heat resistant member of the electron gun in FIG. 5.
Figure 7:
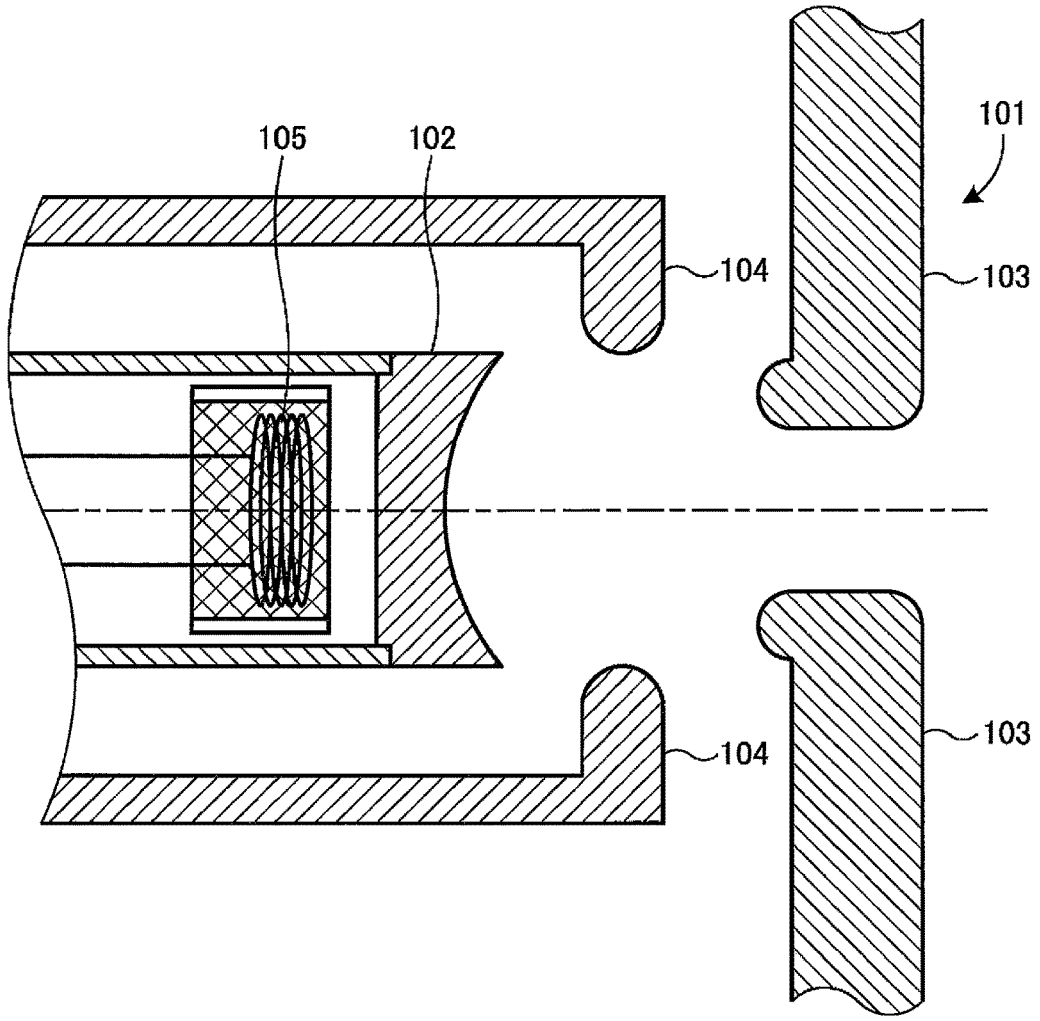
FIG. 7 schematically shows a cross-sectional view of the configuration of a diode electron gun according to the related art.
Figure 8:
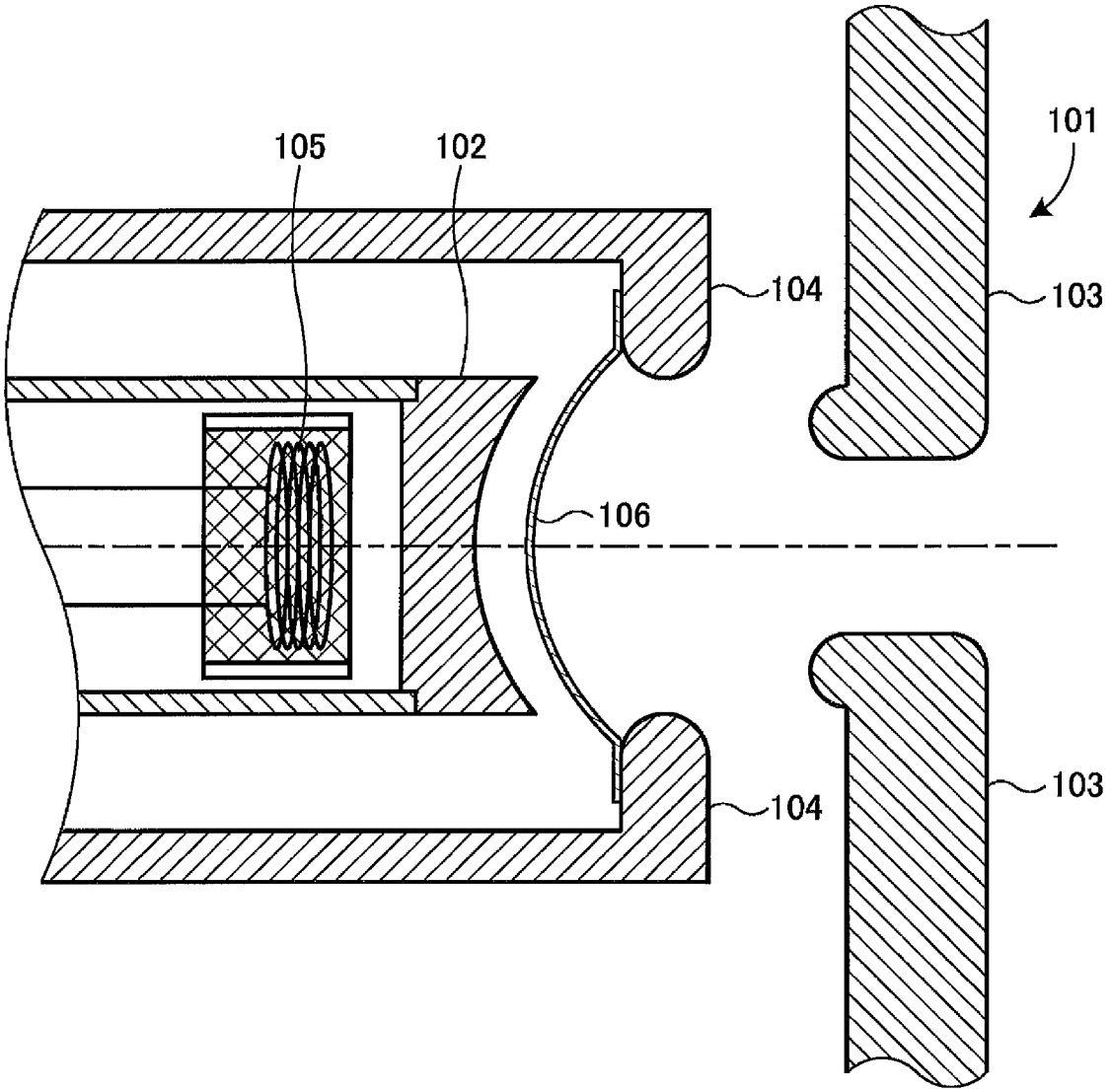
FIG. 8 schematically shows a cross-sectional view of the configuration of a triode electron gun according to the related art.

As shown in FIG. 6, in the heat resistant member 8 according to the embodiment 3, a second portion being positioned between a cathode 2 and a heater 3 is formed as a flat plate-like portion 81 to be installed to the cathode 2, a first portion to close a through hole 21 has a bottomed hollow cylindrical portion 85 that protrudes from one surface of the flat plate-like portion 81, and the above-mentioned bottomed hollow cylindrical portion 85 is inserted into the through hole 21 of the cathode 2. The flat plate-like portion 81 is joined to the bottom surface of the cathode 2 to allow the heat resistant member 8 to be installed to the cathode 2 such that the bottomed hollow cylindrical portion 85 of the heat resistant member 8 is inserted into the through hole of the cathode 2. In the example in FIG. 6, the flat plate-like portion 81 is formed into a circle and is made to be the flat plate-like portion 81 being circular. In this way, the bottomed hollow cylindrical portion 85 is inserted into the through hole 21, making it possible to stably conducts heat from the heater 3 to the cathode 2 and to catch returned back electrons with the heat resistant member 8 even when they return.

An outer peripheral surface 86 of the bottomed hollow cylindrical portion 85 of the heat resistant member 8 and an inner peripheral surface of the through hole 21 of the cathode 2 can be brought into contact with each other, or a gap can be provided between the outer peripheral surface 86 of the bottomed hollow cylindrical portion 85 and the inner peripheral surface of the through hole 21. In the example shown in FIG. 6, one having a column portion (bottom portion) in a portion that protrudes from one surface (upper surface) of a second portion is set to be the bottomed hollow cylindrical portion 85. In a case that there is no bottom portion in the above, in other words, portions that protrude from one surface of a second portion are all hollow cylindrical form, the through hole 21 can be closed with a flat plate portion being formed integrally with the second portion. The bottomed hollow cylindrical portion 85 makes it possible to increase the thickness of the portion opposing the through hole 21 more than that of the second portion because of the presence of the above-mentioned bottom portion, making it possible to effectively prevent to thermal deforming due to back bombardment.

According to the heat resistant member 8 in the above-mentioned embodiment 3, the returned back electrons that come back toward the electron gun 1 pass through the through hole 21 of the cathode 2 to collide with the heat resistant member 8 (specifically, the bottom portion of the bottomed hollow cylindrical portion 85, or the first portion inside the hollow cylindrical portion that oppose the through hole 21) and energy of the returned back electrons is converted to heat. Moreover, the hollow cylindrical portion or the bottomed hollow cylindrical portion 85 being inserted into the through hole 21 of the cathode 2 makes it possible to conduct radiant heat from the heater 3 (heat thorough the insulating material 10 or the sleeve 9) or heat generated due to back bombardment to the cathode 2 to improve the heating efficiency of the cathode 2 and, at the same time, to achieve stabilizing of temperature. Furthermore, emission from the inner surface of the through hole 21 of the cathode 2 due to the electron emission substance can be prevented, thereby making it possible to improve the stability and the accuracy of electron beam forming. Moreover, in a case of adopting the hollow cylindrical portion or the bottomed hollow cylindrical portion 85, the heat resistant member 8 is preferably formed by a two-piece process utilizing a rod material, not the one-piece process.

Even in a case that the heat resistant member 8 shown in FIG. 6 is used, the grid 6 can be installed to the Wehnelt 5.

While explanations have been given for embodiments 1 to 3 of the present invention in the above, the specific configuration is construed to be not limited to the above-described embodiments 1 to 3, so that any design changes in the embodiments without departing from the gist of the present invention is included in the scope of the present invention. For example, while the heat resistant member 8 is installed to the cathode 2 via the flat plate-like portion 81 according to the above-described embodiments 1 to 3, how the heat resistant member 8 is installed is construed to be not limited to a specific mode as long as it is arranged between the cathode 2 and the heater 3.

[1] The present disclosure relates to an electron gun comprising a cathode having an electron emitting surface and whose planar shape is circular; a heater; and an anode being arranged to oppose the cathode, wherein a through hole along a central axis of the cathode is provided in a central portion of the cathode; and a heat resistant member having a first portion to close the through hole and a second portion being positioned between the cathode and the heater is arranged in the electron gun. In this way, even in an electron gun being designed with a very high beam current density, not only a local shock and heat generation at the center of the surface of the cathode can be suppressed and damaging of the cathode can be prevented, but also, as the electrons and ions that return to the electron gun side collide with the heat resistant member, heat generation due to back bombardment of these electrons and ions can be conducted and diffused to portions other than the cathode surface by the heat resistant member, making it possible to decrease a temperature rise and degradation of the heater and the insulating material. As a result, change in the physical property of the electron gun can be prevented and a stable thermionic emission can be secured for a long time, the electron gun being brought to be unusable due to degradation of the cathode, the heater and the insulating material before reaching the life time of the cathode can be avoided, making it possible to achieve a longer life.

[2] According to the present disclosure, the electron gun according to [1] in the above further comprises a grid between the cathode and the anode, wherein a hole of the grid can be provided coaxially with the through hole of the cathode. In this case, upon providing the grid, the hole is provided in the grid, so that the flow rate of electrons that passes through the grid from the cathode to advance, or, in other words, the cathode current can be controlled, making it possible to improve the operability of the electron gun, and, moreover, a local shock and heat generation in the central portion of the grid can be suppressed, making it possible to prevent damaging of the grid.

[3] According to the present disclosure, in the electron gun according to [1] or [2] in the above, the second portion of the heat resistant member can be formed more thinly than the first portion. In this way, as the thickness of the heat resistant member is varied depending on the position, with a portion to receive back bombardment in the through hole of the cathode being thickened to diffuse well the heat generation due to electrons and ions returning to the electron gun side to prevent thermal deforming, the thickness of the second portion that exists between the bottom surface of the cathode and the heater can be decreased to secure well the efficiency of heating the cathode using the heater.

[4] According to the present disclosure, in the electron gun according to [1] or [2] in the above, the first portion of the heat resistant member can have a hollow cylindrical portion or a bottomed hollow cylindrical portion that protrudes from one surface of the second portion, and the hollow cylindrical portion or the bottomed hollow cylindrical portion can be inserted into the through hole. In this way, as a portion of the heat resistant member to be inserted into the through hole of the cathode is hollow cylinder-like or bottomed hollow cylinder-like, heat radiation from the heater or heat generation due to back bombardment can be efficiently conducted to the cathode to improve the heating efficiency of the cathode.

[5] According to the present disclosure, in the electron gun according to [1] or [4] in the above, one or a plurality of notches or holes can be formed in the second portion of the heat resistant member. In this way, as a notch or a hole is formed in a portion of the heat resistant member that is positioned between the cathode and the heater, heat radiation from the heater can be more efficiently conducted to the cathode to further improve the heating efficiency of the cathode.

[6] According to the present disclosure, in the electron gun according to any one of [1] to [5] in the above, the heat resistant member can be formed with a metal and can be connected to a part to be the same electric potential as that of the cathode. In this way, the heat resistant member is to have the same electric potential as the cathode, making it possible to eliminate blocking of the workings of making electrons being emitted from the cathode advance such that they move toward the anode by the voltage as a difference between the electric potential applied to the anode and the electric potential applied to the cathode.

1 electron gun
2 cathode
21 through hole
3 heater
4 anode
41 opening
5 Wehnelt
6 grid
61 hole
8 heat resistant member
81 flat plate-like portion
82 projection
83 peripheral end
84 notch
85 bottomed hollow cylindrical portion
86 outer peripheral portion
9 sleeve
10 insulating material
101 electron gun having related-art configuration
102 cathode
103 anode
104 Wehnelt

105 heater
106 grid
A emission direction (traveling direction) of electrons

What is claimed is:

1. An electron gun comprising a cathode having an electron emitting surface in form of curved concave, whose planar shape is circular and to focus an electron beam; a heater; and an anode being arranged to oppose the cathode, wherein a through hole along a central axis of the cathode is provided in a central portion of the cathode; and a heat resistant member having a first portion to close the through hole and a second portion being jointed to a bottom surface being a surface opposite to the electron emitting surface of the cathode is arranged in the electron gun; and the first portion has a projection portion that protrudes from a jointing plane between the second portion and the bottom surface toward the through hole, and a thickness of the projection is not less than one fourth and not more than one tenth of a depth of the through hole.

2. The electron gun according to claim 1, further comprising a grid between the cathode and the anode, wherein a hole of the grid is provided coaxially with the through hole of the cathode.

3. The electron gun according to claim 2, wherein the heat resistant member is formed with a metal having higher thermal conductivity than that of the cathode and is connected to a part to be the same electric potential as that of the cathode.

4. The electron gun according to claim 1, wherein the projection of the heat resistant member has a hollow cylindrical portion thereon, and the hollow cylindrical portion is positioned within the through hole.

5. The electron gun according to claim 4, wherein one or a plurality of notches or holes is formed in the second portion of the heat resistant member.

6. The electron gun according to claim 4, wherein the heat resistant member is formed with a metal having higher thermal conductivity than that of the cathode and is connected to a part to be the same electric potential as that of the cathode.

7. The electron gun according to claim 4, wherein a thickness of the second portion of the heat resistant member is no greater than 1 mm.

8. The electron gun according to claim 4, wherein a work function of the heat resistant member is higher than that of the cathode.

9. The electron gun according to claim 1, wherein one or a plurality of notches or holes is formed in the second portion of the heat resistant member.

10. The electron gun according to claim 1, wherein the heat resistant member is formed with a metal having higher thermal conductivity than that of the cathode and is connected to a part to be the same electric potential as that of the cathode.

11. The electron gun according to claim 10, wherein a thickness of the second portion of the heat resistant member is no greater than 1 mm.

12. The electron gun according to claim 10, wherein a work function of the heat resistant member is higher than that of the cathode.

13. The electron gun according to claim 1, wherein a thickness of the second portion of the heat resistant member is no greater than 1 mm.

14. The electron gun according to claim 13, wherein a work function of the heat resistant member is higher than that of the cathode.

15. The electron gun according to claim 1, wherein a work function of the heat resistant member is higher than that of the cathode.

16. An electron gun comprising a cathode having an electron emitting surface in form of curved concave, whose planar shape is circular and to focus an electron beam; a heater; and an anode being arranged to oppose the cathode, wherein a through hole along a central axis of the cathode is provided in a central portion of the cathode; and a heat resistant member having a first portion to close the through hole and a second portion being jointed to a bottom surface being a surface opposite to the electron emitting surface of the cathode is arranged in the electron gun; and the first portion has a hollow cylindrical portion that protrudes from a jointing plane between the second portion and the bottom surface toward the through hole, and the hollow cylindrical portion is inserted into the through hole.

17. The electron gun according to claim 16, wherein one or a plurality of notches or holes is formed in the second portion of the heat resistant member.

18. The electron gun according to claim 16, wherein the heat resistant member is formed with a metal having higher thermal conductivity than that of the cathode and is connected to a part to be the same electric potential as that of the cathode.

19. The electron gun according to claim 16, wherein a thickness of the second portion of the heat resistant member is no greater than 1 mm.

20. The electron gun according to claim 16, wherein a work function of the heat resistant member is higher than that of the cathode.

* * * * *